US010337089B2

(12) United States Patent
Broda et al.

(10) Patent No.: US 10,337,089 B2
(45) Date of Patent: Jul. 2, 2019

(54) PROCESS FOR PRODUCING A COMPONENT MADE OF HEAT-TREATED CAST IRON

(71) Applicant: FORD GLOBAL TECHNOLOGIES, LLC, Dearborn, MI (US)

(72) Inventors: Maik Broda, Wuerselen NRW (DE); Christopher K. Palazzolo, Ann Arbor, MI (US); Uemit Ursavas, Leverkusen NRW (DE); Glen Weber, Northville, MI (US); Matthias Warkentin, Kerpen (DE)

(73) Assignee: Ford Global Technologies, LLC, Dearborn, MI (US)

( * ) Notice: Subject to any disclaimer, the term of this patent is extended or adjusted under 35 U.S.C. 154(b) by 779 days.

(21) Appl. No.: 14/806,313

(22) Filed: Jul. 22, 2015

(65) Prior Publication Data

US 2016/0024622 A1 Jan. 28, 2016

(30) Foreign Application Priority Data

Jul. 25, 2014 (DE) ..... 10 2014 214 640

(51) Int. Cl.
*C22C 37/00* (2006.01)
*C21D 5/00* (2006.01)
(Continued)

(52) U.S. Cl.
CPC ..... *C22C 37/00* (2013.01); *C21D 1/18* (2013.01); *C21D 5/00* (2013.01); *C21D 8/005* (2013.01)

(58) Field of Classification Search
CPC ..... C21D 2211/003; C21D 8/0236; C21D 8/0247; C21D 8/0273; C21D 8/1261;
(Continued)

(56) References Cited

U.S. PATENT DOCUMENTS 5,082,507 A * 1/1992 Curry ..... C21D 1/20 148/321
2004/0112479 A1* 6/2004 Druschitz ..... C21D 5/00 148/545
(Continued)

FOREIGN PATENT DOCUMENTS

CN 103103321 A 5/2013
DE 158112 A1 12/1982
(Continued)

OTHER PUBLICATIONS

Lefevre, Justin et al., Austempered Materials for Powertrain Applications, Journal of Materials Engineering and Performance, 1914—vol. 22(7), Jul. 2013, pp. 9.
(Continued)

*Primary Examiner* — Veronica F Faison
(74) *Attorney, Agent, or Firm* — Ray Coppiellie; Brooks Kushman P.C.

(57) ABSTRACT

The disclosure relates to a process for producing a hardened and tempered component made of specially heat-treated cast iron (e.g., AGI). According to the disclosure, a main body made of cast iron is prepared which may already be in the shape of an engine block. The main body may then be subjected to pre-machining, which may include forming one or more bores. Then, the main body may be hardened and tempered by a suitable heat treatment, such as a special heat treatment. After the disclosed heat treatment, post-processing of the component may follow, such as establishing the final dimensions.

20 Claims, 2 Drawing Sheets

(51) Int. Cl.
*C21D 1/18* (2006.01)
*C21D 8/00* (2006.01)

(58) Field of Classification Search
CPC ..... C22C 38/001; C22C 38/02; C22C 38/04; C22C 38/06; C22C 38/12
See application file for complete search history.

(56) References Cited

U.S. PATENT DOCUMENTS

| | | | | |
|---|---|---|---|---|
| 2009/0047164 | A1* | 2/2009 | Menk | C22C 37/04 420/14 |
| 2010/0111662 | A1* | 5/2010 | Larker | C21D 5/00 414/723 |

FOREIGN PATENT DOCUMENTS

| | | | |
|---|---|---|---|
| DE | 102005028588 | A1 | 1/2007 |
| DE | 102010010991 | A1 | 9/2011 |
| EP | 0 144 907 | A2 | 6/1985 |
| EP | 0 374 116 | A1 | 6/1990 |
| EP | 1032770 | B | 4/2003 |

OTHER PUBLICATIONS

Vadiraj, Aravind et al., Mechanical and Wear Behavior of Quenched and Tempered Alloyed Hypereutectic Gray Cast Iron, Materials and Design 32, 2011, pp. 2438-2443.

Chinese Office Action dated Dec. 27, 2017 in Chinese Application No. 201510412304.3, pp. 9.

Broda, Maik et al., AGI Machining Process, New Production Process for an Improved Machining of Austempered Gray Cast Iron (AGI), pp. 3.

* cited by examiner

PROCESS FOR PRODUCING A COMPONENT MADE OF HEAT-TREATED CAST IRON

CROSS-REFERENCE TO RELATED APPLICATIONS

This application claims foreign priority benefits under 35 U.S.C. § 119(a)-(d) to DE 10 2014 214 640.2 filed Jul. 25, 2014, which is hereby incorporated by reference in its entirety.

TECHNICAL FIELD

The present disclosure relates to a process for producing a component made of heat-treated cast iron.

BACKGROUND

Metallic components made of cast iron have the advantage over components produced by means of a purely mechanical process, in that they are already largely shaped during the casting. In this context, the casting material is heated to its transition into the liquid phase and is then cast in a mold. As it cools, it solidifies to give a main body with a predefined shape. In particular, more complex component shapes can thus be created. Casting may be the only method for creating some parts, or it may make production more economical. The latter generally requires relatively large production runs as the effort and the associated costs for the necessary molds may be relatively high.

Typically, for producing components by casting, use is made of suitable iron alloys which have a high proportion of carbon. This can be present as graphite or as cementite. Depending on the type of carbon present, a distinction is made between gray cast iron (graphite) or white cast iron (cementite). With respect to the mechanical properties of such cast iron, the graphite plays a role. For example, cast iron is divided into that with graphite flakes and that with spheroidal graphite.

By virtue of the advantages described in the introduction, cast iron is increasingly used in automotive construction and, in this case in particular, in the field of engine production. Following the general trend of downsizing, which generally refers to reducing weight while retaining strength properties, the material cast iron is coming back into focus. Indeed, it has been possible, for this material too, for new production methods to be developed with which it is possible to achieve higher strength values. Thus, various possibilities are now known for the heat treatment of cast iron, in order to achieve both an increase in its strength and an improvement in its elongation at break properties. In this context, a specially heat treated cast iron has been developed which is also known as austempered gray iron, or AGI for short. AGI may be extremely strong with good elongation properties, while at the same time having high fatigue strength and resistance to wear. EP 1 032 770 B1, for example, relates to an AGI in the context of brake disks. However, only the brake disk body itself is made of the AGI, wherein the wheel hub of the brake disk is made of another material. For example, the wheel hub may be formed of a normal cast iron, cast steel, or wrought steel with a tensile strength greater than 170 $N/mm^2$. Both materials are assembled by composite casting of the wheel hub with the brake disk body, forming an integral bond point in the connection region. After turning down and hardening, this component undergoes bainitic hardening and is then polished.

However, the abovementioned advantageous properties (e.g. higher strength) are associated with extensive practical production drawbacks. In this case it is the processing, in particular the machining of components made of specially heat-treated cast iron, which proves to be very difficult on account of the increased strength and hardness. In this context, the principal drawbacks are the long processing times and the wear on the processing tools.

Taking into account the inherently positive properties of heat-treated cast iron, that is to say hardened and tempered cast iron, there may still be room for improvement, in particular in terms of its machining.

Against this background, the present disclosure includes developing a process for producing a component made of heat-treated cast iron with the aim of minimizing, overall, the finishing effort associated therewith, and thus improving the competitiveness, in terms of production costs, of components made of cast iron which is hardened and tempered in intermediate steps.

SUMMARY

According to the disclosure, this object may be achieved by means of the disclosed production process. Further advantageous refinements of the process are also disclosed.

It is pointed out that the features specified individually in the following description may be combined with one another in any desired technically meaningful way and thus disclose further refinements of the disclosed invention.

Hereinbelow is presented a process which is suited to the production of a component made of heat-treated cast iron. In the meaning of the disclosure, 'heat treatment of the cast iron' is to be understood as such a special heat treatment in which an entirely ausferritic microstructure is established with an ideally 100% ausferritic hardening of the relevant component. The special heat treatment according to the disclosure involves quenching in a salt bath.

According to the disclosure, a main body made of cast iron may be prepared, for example, an engine block. This can be previously generated by means of a suitable casting process. Aside from any deflashing work, the disclosure relates in particular to the fact that the cast main body (e.g., an engine block) requires further processing. To that end, the not yet heat-treated main body is first machined. According to the disclosure, the main body first machined in this manner only then undergoes the special heat treatment, in order to harden and temper it. In other words, the cast iron is converted into a hardened and tempered cast iron only after the main body, which has not been hardened and tempered, has been machined.

The advantage resulting therefrom may lie in the fact that it is thereby possible for the main body to be machined in a rapid and low-wear manner at a time at which the main body does not yet have increased strength properties. Only after the machining is the main body actually hardened and tempered in the course of the special heat treatment, as set out above.

In one embodiment, the machining disclosed here can be considered in the manner of a pre-processing, which of course does not necessarily have to exclude possible post-processing, in particular post-machining.

According to the disclosure, it is provided that, in the context of the machining, the main body can be honed, at least in certain regions. In the present disclosure, honing is understood as a chip-removing fine processing of surface regions. This is generally carried out mechanically by contact with a corresponding honing tool. Of course, the honing can also be performed in the manner of a removal, as can be carried out for example using a laser.

Further, in the context of machining the main body, at least one bore may be arranged in or on the former. In the present disclosure, a bore can be understood as both a through bore and a partial bore, for example a blind bore.

It is to be noted that said honing and/or boring can also be carried out in the context of any subsequent processing after the special heat treatment, that is to say after hardening and tempering the main body. To that extent, the machining mentioned here can also be understood as meaning a post-processing. This applies in particular against the background that generally honing and occasionally boring are used for improving the measurement precision and/or the shape precision of component regions.

Advantageously, the main body can be heated to a temperature of e.g. 850° C. to 950° C. only after it has been machined. In one embodiment, it may be heated within the context of its special heat treatment as defined above. In this context, it is provided that the heating can take place in a suitable oven. In one embodiment, the heating can then take place under a protective atmosphere. The residence time is appropriately determined taking into account, for example, the wall thickness and/or the chemical composition of the not yet heat-treated main body, such that the abovementioned properties (ausferritic microstructure, ausferritic hardening) are established.

Subsequent to the heating of the already-machined main body, it is provided that, in the context of the special heat treatment, the latter can be cooled in a salt bath after it has been heated. The temperature of the salt bath for the conversion may lie in a temperature range of 220° C. to 450° C. The conversion time may be several hours. In one embodiment, the conversion time is fixed such that there preferably results in an above—90%, for example 100%, conversion to ausferritic cast iron.

The finished part may be an engine block. In this manner, the advantageous properties of the specially heat-treated cast iron can be combined with the simple and cost-effective production for engine blocks according to the disclosure.

Although the disclosure does not assume an essential or at least homogeneous shape change of the main body during its special heat treatment, it is however considered to be advantageous if a possible shape change as a consequence of its subsequent special heat treatment (e.g., hardening and tempering) can accordingly be taken into account already during machining of the main body. To that end, it is for example possible for any openings to be made accordingly smaller or bigger in the context of the machining which takes place before the special heat treatment, such that these openings already have high dimensional stability after the special heat treatment.

According to one embodiment of the disclosure, the main body which has already been hardened and tempered by the special heat treatment can subsequently be post-processed, at least in certain regions. It is thus possible, for example, for surface regions of the main body to be given their final dimensions.

Here, too, the properties of the now specially heat-treated cast iron, which have been improved by the hardening and tempering, more or less oppose the post-processing, but only to a limited extent. In other words, at this point the main machining work has already been performed, such that the post-processing can now essentially be reduced to forming the desired final dimensions.

It is further considered, in conjunction with the post-processing, that also only at this point at least one opening in the main body already hardened and tempered by the special heat treatment can then at least partially be post-processed to its final dimensions. Within the context of the disclosure, an opening is also to be understood as a bore. In addition, reference is made to the above statements with respect to honing and/or boring.

It is also possible, in the context of the post-processing, for the at least one opening in the main body already hardened and tempered by the special heat treatment to subsequently be at least partially provided with a thread. This may provide high dimensional stability of the necessary thread, and may require little effort.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
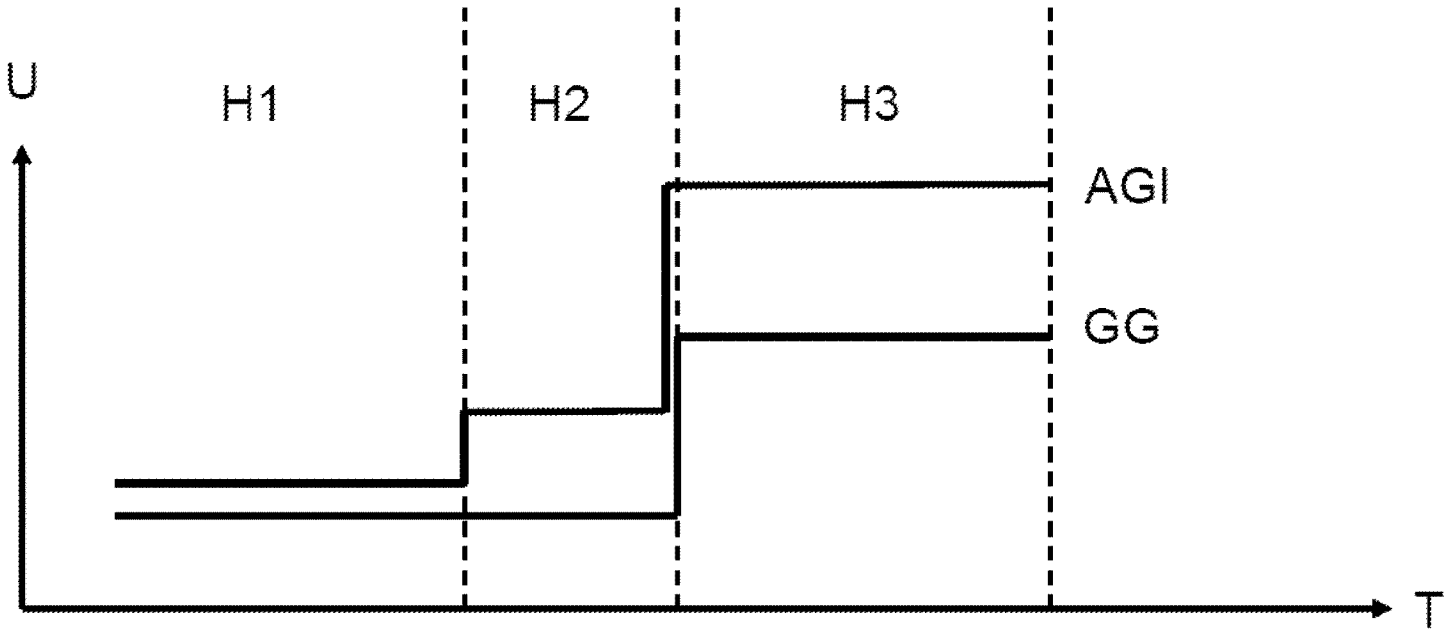
FIG. 1 Prior art
FIG. 1 shows a production process, for example for an engine block, according to the prior art.

FIG. 1 shows, in stylized form, the typical production sequence for components made of normal cast iron (line GG, solid) and made of specially heat-treated cast iron (line AGI, solid). This proceeds from casting H1 the main body, via hardening and tempering the latter, through a special heat treatment H2 and the subsequent machining H3 to the finished component. The production sequence shown in diagrammatic form indicates, on its abscissa, information relating to the required time T with respect to the costs U, which analogously extend along the ordinate.

In that context, the upper curve represents the production of a component AGI made of specially heat-treated cast iron, whereas the lower curve represents the production of a conventional cast iron component GG. As can be seen, the costs for producing components made of heat-treated cast iron are typically higher than with conventional cast iron components made of gray cast iron (GG). Here, in addition to the heat treatment H2, it is in particular the machining H3 which is responsible for these high costs. This is because the heat-treated main body is substantially harder, which leads to substantial wear of the processing tools, such that these have to be replaced early (e.g., obtained anew).

Figure 2:
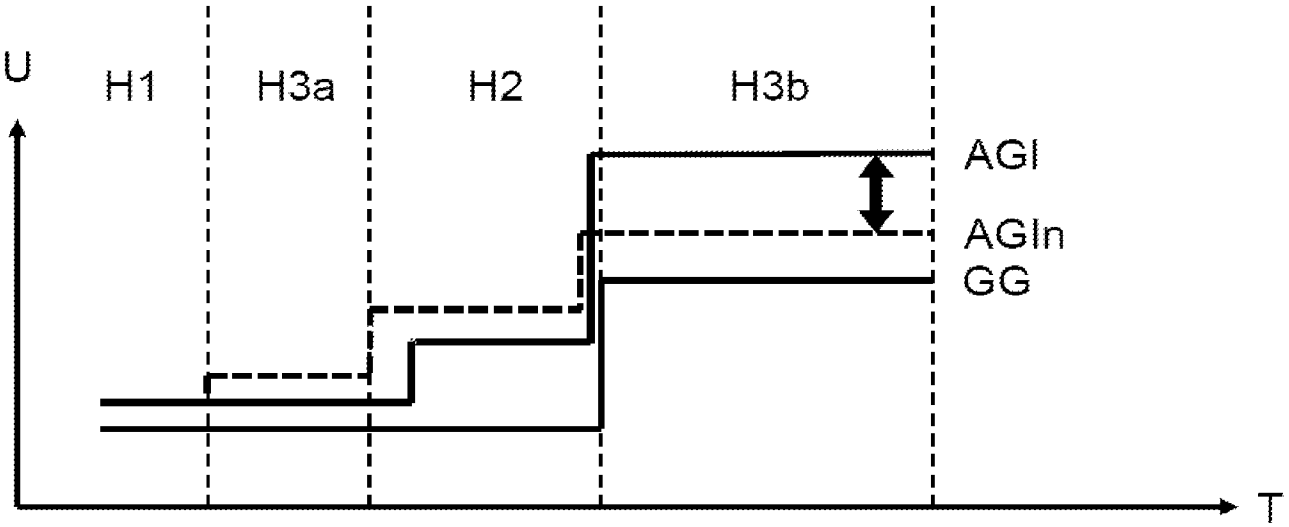
FIG. 2 shows the diagram from FIG. 1, modified to include a production process, according to an embodiment.

FIG. 2 now shows the result that can be achieved with the process according to the disclosure, with respect to costs. In order to be able to better differentiate, here the component which can be made of specially heat-treated cast iron (e.g., an engine block) which is processed subsequent to the special heat treatment, is labeled AGIn. The graph AGIn is dotted. The component (e.g., an engine block) can be produced visibly more cost-effectively with the processes according to the disclosure.

The cost savings in this context lie in particular in the machining H3 which, according to the disclosure, is divided into a pre-processing H3*a* and a post-processing, or finishing, H3*b*. Since the essential processing takes place in the context of the pre-processing H3*a*, there is a marked reduction in the effort and thus the costs in the post-processing, or finishing, H3*b*. However, it must be noted that the prior pre-processing process also involves costs, such that, at first, the graph AGIn lies above the graph AGI in the regions H3*a* and H2. However, this initial cost factor is more than compensated for—and indeed is markedly reduced—by the lower effort of processing and by the lower wear on the processing tools after the special heat treatment, as shown by the double arrow between the graphs AGI and AGIn. The double arrow represents the cost advantage of the procedure according to the disclosure over the conventional procedure.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A process comprising:

casting an engine block main body from a cast iron;

boring the main body to form a bore having a first shape;

heat treating the main body having the bore to establish an ausferritic microstructure of the main body and the bore having a second shape; and machining the bore having the second shape after the heat treating step.

2. The process of claim 1, wherein the main body is heated to a temperature of 850° C. to 950° C. during the heat treating step.

3. The process of claim 1, further comprising cooling the main body in a salt bath after the heat treating step.

4. The process of claim 3, wherein the salt bath has a temperature of 220° C. to 450° C.

5. The process of claim 1, wherein the machining step includes threading the bore with a mechanical process to form a thread on the bore after the heat treating step.

6. The process of claim 1, wherein the heat treating step establishes an at least 90% ausferritic microstructure in the main body.

7. The process of claim 1, wherein the heat treating step establishes a 100% ausferritic microstructure.

8. The process of claim 1, wherein the heat treating step is performed under a protective atmosphere.

9. The process of claim 1, wherein the one bore is a through bore or a partial bore.

10. A process comprising:

casting an engine block main body from a cast iron;

boring the main body to form a bore having a first shape;

heat treating the main body to establish an at least 90% ausferritic microstructure in the main body and the bore having a second shape; and machining the bore having the second shape after the heat treating step.

11. The process of claim 10, wherein the main body is heated to a temperature of 850° C. to 950° C. during the heat treating step.

12. The process of claim 10, further comprising cooling the main body in a salt bath after the heat treating step.

13. The process of claim 10, wherein the machining step includes threading the bore with a mechanical process to form a thread on the bore after the heat treating step.

14. The process of claim 10, wherein the heat treating step establishes a 100% ausferritic microstructure.

15. The process of claim 10, wherein the heat treating step is performed under a protective atmosphere.

16. The process of claim 10, wherein the bore is a through bore or a partial bore.

17. A process comprising:

casting an engine block from a cast iron;

boring the engine block to form a bore having a first shape;

heat treating the engine block having the bore at a temperature of 850° C. to 950° C. to establish an at least 90% ausferritic microstructure in the engine block and the bore having a second shape; and machining the bore having the second shape after the heat treating step.

18. The process of claim 17, wherein the machining step includes threading the bore with a mechanical process to form a thread on the bore after the heat treating step.

19. The process of claim 17, further comprising machining the engine block after the heat treating step.

20. The process of claim 17, further comprising machining surface regions of the engine block after the heat treating step.

* * * * *